United States Patent [19]

Lueders et al.

[11] Patent Number: 4,986,358

[45] Date of Patent: Jan. 22, 1991

[54] FLAPPER MOUNT FOR WELL SAFETY VALVE

[75] Inventors: Edgar D. Lueders, Stafford; Brian A. Roth, Houston, both of Tex.

[73] Assignee: Camco International Inc., Houston, Tex.

[21] Appl. No.: 509,531

[22] Filed: Apr. 16, 1990

[51] Int. Cl.[5] ..... E21B 34/10

[52] U.S. Cl. ..... 166/321; 166/322; 166/332; 251/298; 251/303

[58] Field of Search ..... 166/319, 321, 322, 332; 251/298, 303, 228

[56] References Cited

U.S. PATENT DOCUMENTS 3,815,619 6/1974 Ross et al. ..... 251/303 X 4,457,376 7/1984 Carmody et al. ..... 251/298 X 4,531,587 7/1985 Fineberg ..... 166/332

4,776,400 10/1988 Jacob et al. ..... 166/321

4,854,387 8/1989 Pringle ..... 166/321

4,926,945 5/1990 Pringle et al. ..... 166/321

*Primary Examiner*—Hoang C. Dang

*Attorney, Agent, or Firm*—Fulbright & Jaworski

[57] ABSTRACT

A one-piece flapper mount for a wireline retrievable hydraulic piston actuated wrap-around flapper safety valve. The flapper mount has opposing openings between the valve seat and the nose seal and the openings are sized for insertion of the flapper valve and nose seal with support ribs between the openings. The single piece construction allows setting and retrieving the safety valve in a single trip. The one-piece mount also has the advantage of ease of orientation of coacting parts.

5 Claims, 4 Drawing Sheets

FLAPPER MOUNT FOR WELL SAFETY VALVE

BACKGROUND OF THE INVENTION

The present invention is directed to a large bore retrievable well safety valve such as described in U.S. Pat. No. 4,854,387 and U.S. patent application Ser. No. 07/404,241, filed Sept. 7, 1989, now U.S. Pat. No. 4,926,945. Such valves are designed to provide large bores thus increasing well production through the valves. However, such valves have a separate nose subassembly. Because of the nose assembly, separate trips into the well and out of the well for setting and removing such a safety valve are required. In addition, the nose assembly includes a mating downstop which may include a nose seal and must be oriented relative to the valve in a landing nipple.

The present invention is directed to a safety valve which utilizes a one-piece mount which contains and supports both the arcuate wrap-around flapper as well as the downstop for mating against the valve flow tube. The single piece mount of the present invention has the advantage in that it (1) allows easy assembly of parts which need to be oriented, (2) allows better reliability of mating the flow tube in the nose by insuring that the orientation of the nose and the flow tube are matched, (3) allows more precise calibration of the safety valve and power spring by closely held dimensions and (4) allows easier setting and retrieving of the wireline assembly using fewer trips and fewer different types of equipment.

SUMMARY

The present invention is directed to a subsurface well safety valve for controlling the fluid flow through a well conduit and includes a housing having an axial bore therethrough in which the housing includes a one-piece flapper mount. A valve seat is positioned in the flapper mount, and a flapper valve member, which is movable between open and closed positions relative to the valve seat, is supported from the mount. The valve closure member is a sector of a cylinder having a concave surface which forms a sealing surface. The valve seat has a seating surface contoured to coact with the sealing surface. A flow tube is telescopically movable in the housing for controlling the movement of the flapper valve member and a nose downstop which may include a seal is carried by the mount below and positioned for engagement by the flow tube. The flapper mount has opposing openings between the valve seat and the nose seal and the openings are sized for insertion of the flapper valve and the nose seal for mounting in the flapper mount.

Still a further object of the present invention is wherein the flapper mount includes first and second opposing ribs between the openings for providing a one-piece mount for insertion and removal with the valve as well as orientation of coacting parts.

Yet a still further object of the present invention is wherein the flapper valve is supported from the flapper mount by hinge means and the openings are rotationally positioned relative to the hinge means at 0° and 180°.

In addition, the first and second opposing ribs are rotatably positioned relative to the hinge means at 90° and 270°.

Yet a still further object of the present invention is the method of making a one-piece metal flapper mount for a subsurface well safety valve having a flapper closure member which is a sector of a cylinder with a concave sealing surface. The method includes cutting an external recess in a tubular body about a concentric center line for receiving external seals and cutting an orientation connection adjacent one end of the body for rotationally orienting the body in the safety valve. The method further includes cutting, eccentrically to the center line of the body, a through bore, an interior recess for a seal seat, and a recess for a nose mating downstop. Thereafter, the method includes cutting a valve seat, contoured to mate with the flapper sealing surface in the body, leaving opposing openings in the body sized to admit the flapper and a nose downstop, but leaving opposing external ribs between the opposing openings.

A further object is wherein the method includes simultaneously cutting the opposing openings with an electric discharge machine. In addition, the method includes making a hinge support for the flapper.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1A:
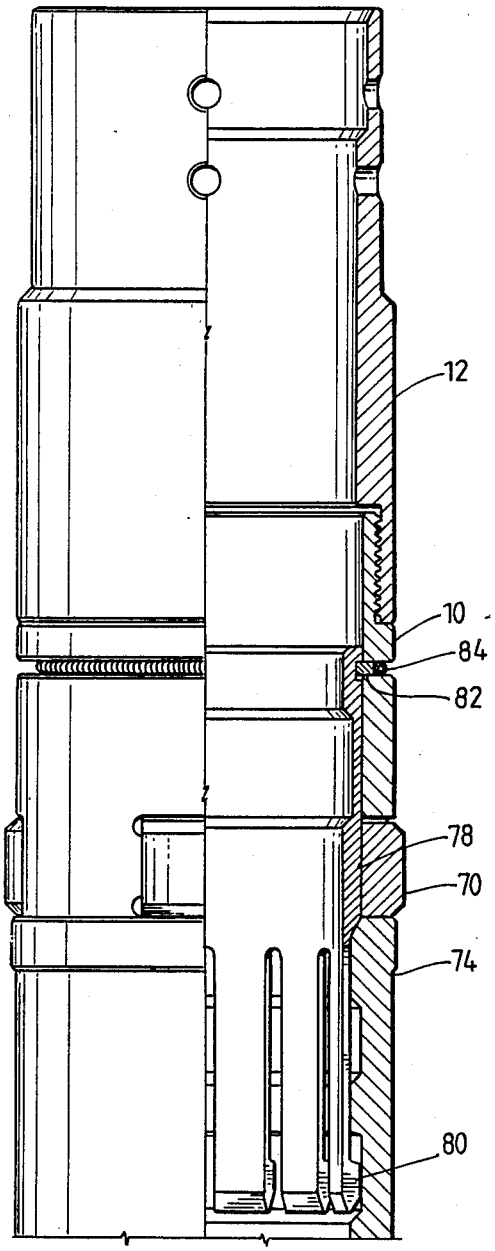
FIGS. 1A, 1B, 1C, and 1D are continuations of each other and are an elevational view, in quarter section, illustrating one embodiment of the present invention.
Figure 1B:
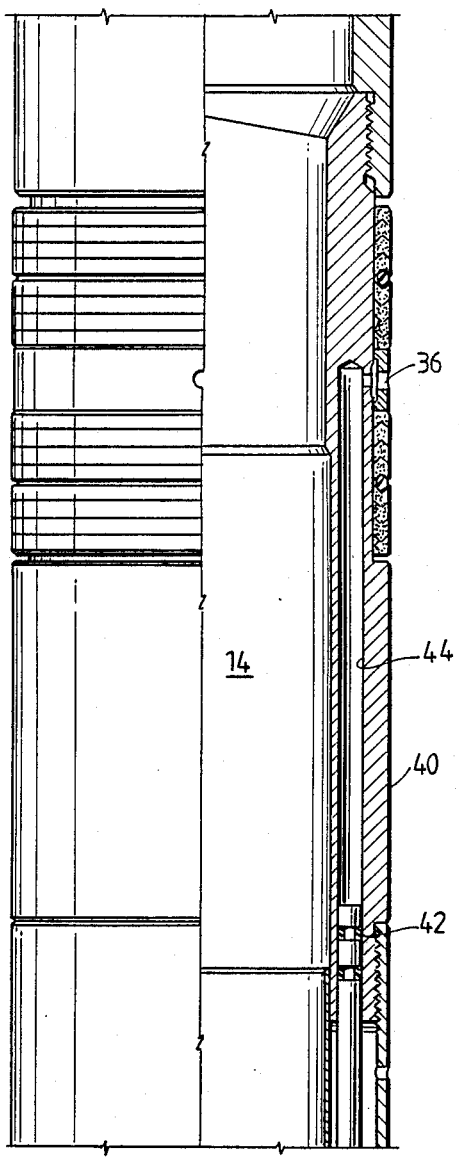
Figure 1C:
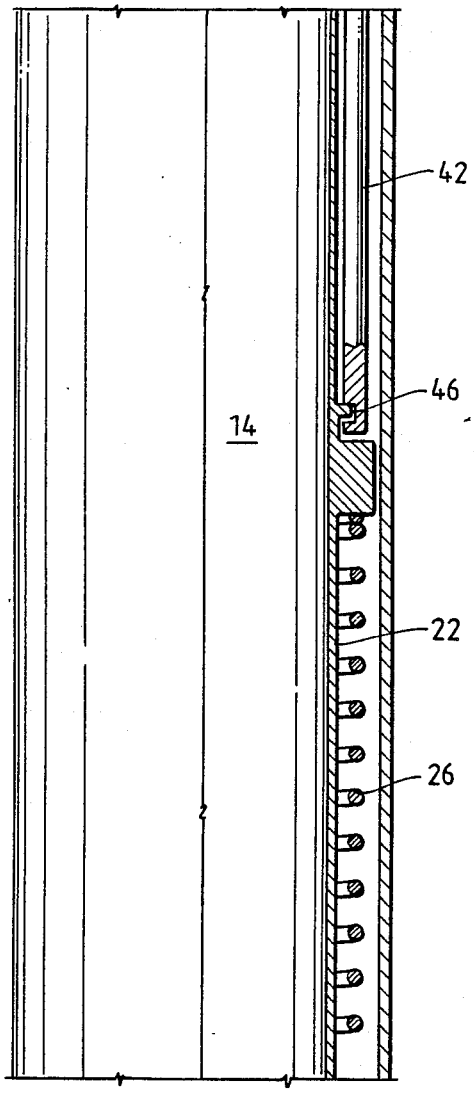

Referring now to the drawings, and particularly to FIGS. 1A, 1B, 1C and 1D, the reference numeral 10 generally indicates a retrievable subsurface safety valve of the present invention. The valve includes a housing 12 and is adapted to be set in or retrieved from a well tubing which includes a landing nipple (not shown) to permit well production therethrough under normal operating conditions, but in which the safety valve 10 may be closed in response to abnormal conditions.

The valve 10 includes an axial bore 14, a curved metal valve seat 16 with a soft seat 17 (FIG. 1D) positioned about the bore 14 in the housing 12, a valve closure member, such as curved flapper 18, which is a sector of a cylinder having a concave surface 19 forming a sealing surface. The flapper 18 is shaped and may be constructed, as more fully described in U.S. Pat. No. 4,926,945, which is incorporated herein by reference. The flapper 18 is supported from a flapper mount 90 by a pivot pin 20. When the flapper 18 is in the upper position and seated on the valve seat 16, the safety valve 10 is closed, blocking flow upwardly through the bore 14 and well tubing. A flow tube or longitudinal tubular member 22 having a lower end 23 is telescopically movable in the housing 12 and through the valve seat 16. As best seen in FIG. 1D, when the flow tube 22 is moved to a downward position, the lower end 23 of the tube 22 pushes the flapper 18 away from the valve seat 16.

Thus, the valve 10 is held in the open position so long as the tube 22 is in the downward position. When the tube is moved upwardly, the flapper 18 is allowed to move upwardly on to the seat 16 by the action of a spring 24 and also by the action of fluid flow moving upwardly through the bore 14.

The flow tube 22 is biased in an upward direction by suitable means which may include a spring 26 (FIGS. 1C and 1D) for yieldably urging the flow tube 22 in an upward direction to release the flapper 18 for closing the valve 10. The safety valve 10 is operated by the application or removal of a pressurized fluid, such as hydraulic fluid, through a control port 36 which is adapted to be supplied with pressurized fluid from the well surface. The control fluid is supplied to the top of a piston and cylinder assembly, generally indicated by the reference numeral 40, which includes a piston 42 movable in a cylinder 44, one of which, here shown as the piston 42, may be connected to the flow tube 22 by a tongue and groove connection 46. The connection 46 also rotationally orientates the flow tube 22 in the bore 14.

Figure 1D:
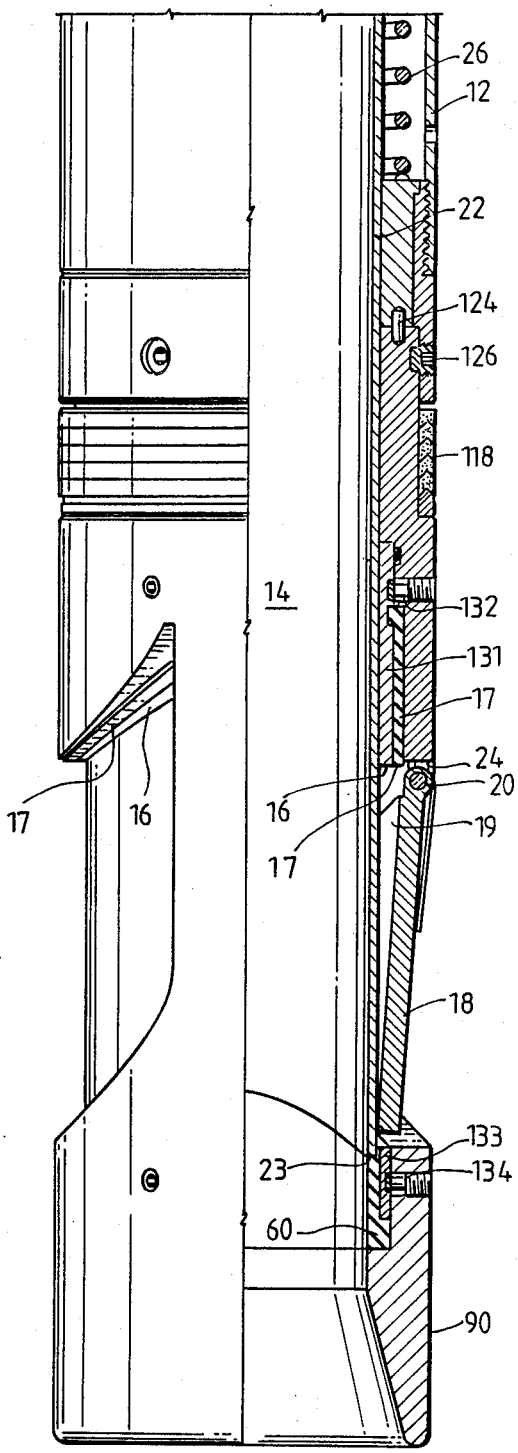

Referring now to FIG. 1A, the valve 10 is generally run into the well conduit and landing nipple on a wireline or pumpdown, for example, a Camco wireline running tool. The housing 12 includes suitable means for connection to the inside of a landing nipple, such as locking dogs 70, which are in the retracted position when being run in but are here shown as in an expanded and locked position. The housing 12 is normally run into a landing nipple until a no-go shoulder 74 on the housing 12 engages a stop shoulder in a landing nipple. Thereafter, a sleeve 78 is moved downwardly to latch the dogs 70 outwardly into a locked position. The sleeve 78 is held in a releasably latched position by collet fingers 80 and pins 82 biased inwardly by a garter spring 84.

The above description of a retrievable well safety valve with an arcuate or wrap-around flapper for allowing the use of large bores to increase production through the valves is generally described in the aforementioned patent and patent application. However, such valves disclose the use of a separate nose subassembly for holding a nose mating downstop. First, the use of a separate nose assembly requires multiple downhole trips with different tools when setting and removing the valve 10. In addition, it is difficult to orient the separate nose subassembly which is required if the flow tube includes a curved end 23 which coacts with the sealing surface 19 of the flapper 18 and therefore also utilizes a mating downstop which may include nose seal 60 which has a coacting contour. While the use of the wrap-around flapper allows a larger flow tube interior diameter to be utilized in the safety valve, this is accomplished by offsetting the center line of the flow tube from the center line of the safety valve. The result of this eccentricity is that proper orientation between the flow tube 22, the wrap-around flapper 18, and the nose seal 60 is required.

The present invention overcomes the disadvantages of the prior art by providing a single or one-piece flapper mount 90 as part of the housing. Thus, the flapper mount 90 provides the required orientation of all of the coacting parts using a single mount. The flapper mount 90 contains both the support for the hinge flapper 18 as well as for the mating downstop 60. Thus, the nose downstop 60 may have a contour to coact with the lower end 23 of the flow tube 22 and be oriented therewith. The single-piece mount 90 has the advantages over the separate nose piece of the prior art in that it (1) allows easy assembly of parts which need to be oriented, (2) allows better reliability of sealing the lower end 23 of the flow tube 22 in the nose seal 60 by insuring that the orientation of the seal 60 and flow tube 22 are matched, (3) allows more precise calibration of the safety valve and power spring by closely held dimensions, and (4) allows easier setting and retrieving of the valve 10 in single trips using similar equipment.

Figure 2:
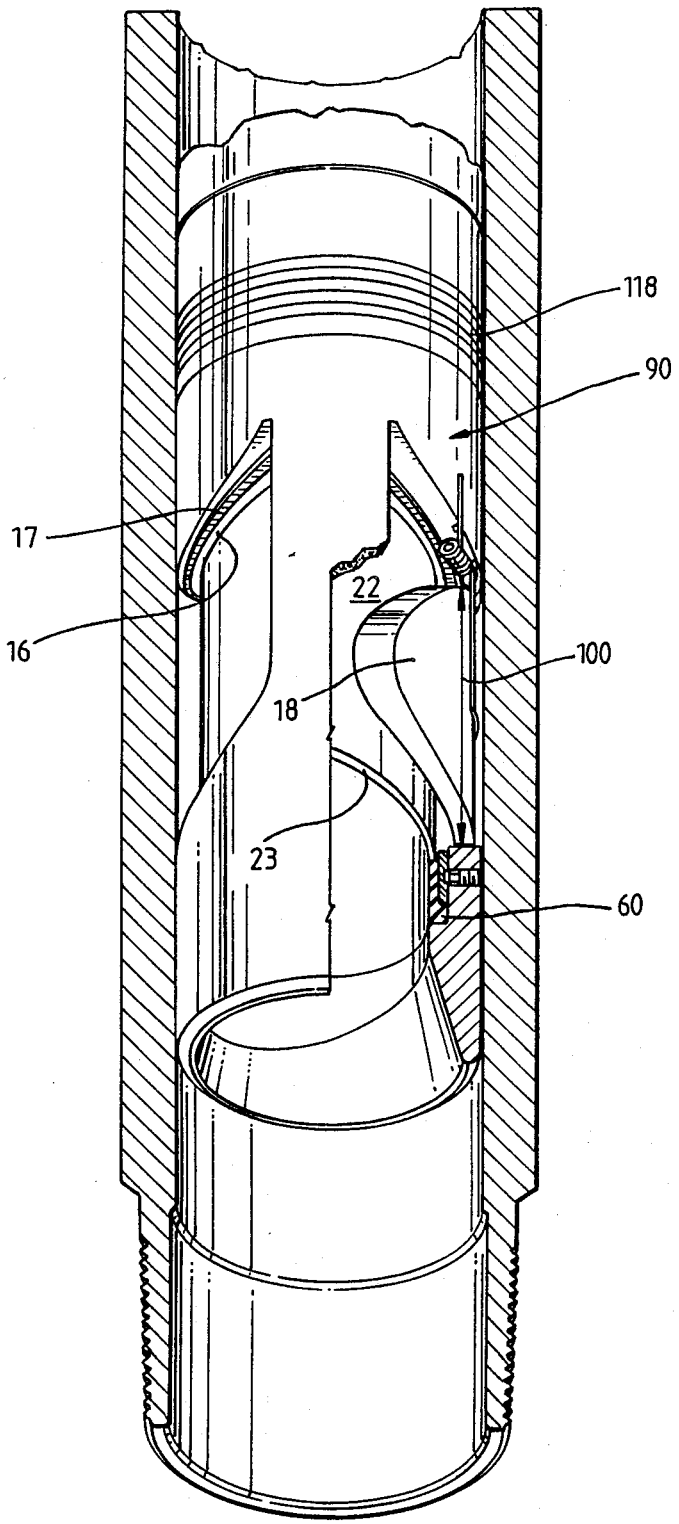
FIG. 2 is an enlarged, elevational perspective view of the one-piece mount of the housing of the present invention.

The difficulty in manufacturing a one-piece flapper mount 90 is that the flapper valve 18 is an arcuate spherical sector and in its closed position wraps the sealing surface 19 around the seal seats 16 and 17 and therefore does not, in the prior art, allow room for connection from the flapper support to the seal 60 support. Nor can a connection of any supporting structure be provided that would extend beyond the OD of the safety valve housing 12. However, as noted in U.S. Pat. No. 4,926,945 the flapper 18 is preferably manufactured by cutting a circular sector out of a tubular member. In the present invention, as best seen in FIG. 2, by slightly reducing the outside diameter 100 of the flapper 18, an area is provided in the outer circumference of the mount 90 to provide oppositely opposing support ribs 102 and 104 and clearance between the flapper 18 and the ribs 102 and 104 (FIGS. 2–5). In addition, by properly manufacturing the flange mount 90, opposing openings 106 and 108 are provided, which allow both the flapper 18 and nose seal 60 to be admitted and properly attached.

Figure 3:
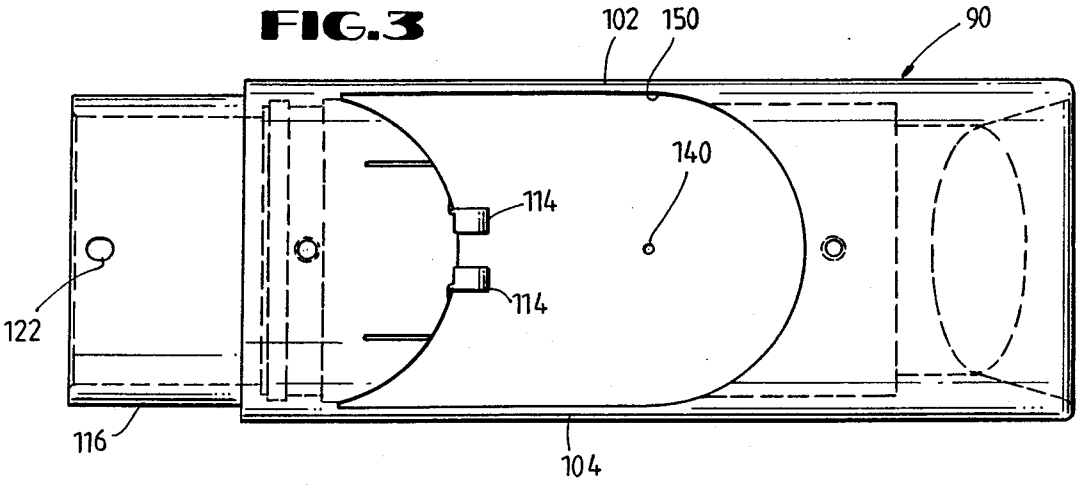
FIG. 3 is a top elevational view of the mount of the one-piece mount of the present invention.
Figure 4:
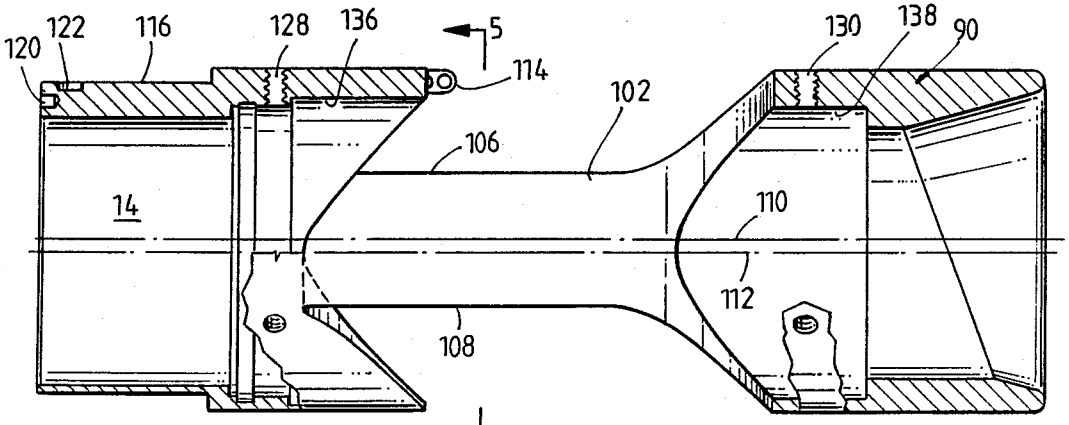
FIG. 4 is a side elevational view- in cross section, of the mount of FIG. 3.
Figure 5:
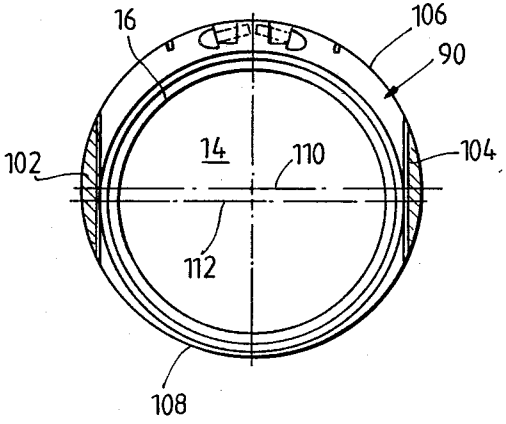
FIG. 5 is a cross-sectional view taken along the line 5—5 of FIG. 4.

Referring now to FIGS. 3, 4 and 5, the method of manufacturing the flapper mount 90 is best seen. First, it is noted that there is a first center line 110 which is the center line of the safety valve 10. Secondly, there is a second center line 112 which is the center line of the flow tube 22. This offset in center lines is due to the necessity to provide an eccentricity in the flapper mount 90 to provide a sufficient structural support for the hinge supports 114 for supporting the pivot pin 20 and the hinge of the flapper 18. Because of this offset, machining of the features on the outside diameter of the mount 90, are generally performed about the center line 110 while structural features on the internal diameter of the mount 90 are performed about the center line 112. Generally, the method includes cutting an external recess 116 on the OD of the mount 90 about the center line 110 for receiving packing seal 118 (FIGS. 1D and 2), and then cutting an orientation connection adjacent one end of the mount 90 for rotationally orienting the mount 90 in the safety valve housing 12. Thus, dowel pin holes 120 and set screw holes 122 are provided in the mount 90 for receiving alignment pin 124 and set screw 126 (FIG. 1D). Additional screw holes 128 and 130 may be provided in the OD of the mount 90 for set screws 132 and 134, respectively (FIG. 1D) for locking in seal retainers 131 and 133, respectively, for retaining the seal 17 and nose seal 60, respectively.

Thereafter, the bore 14 in the mount 90 is cut, eccentrically to the center line 110, that is, about the center line 112 to provide the interior bore 14 therein. Also, similarly cut are an interior recess 136 (FIG. 4) for the soft seat 17 and hard seat and retainer 131 which includes the metal seat 16, as well as the recess 138 (FIG. 4) for the nose seal 60 and retainer 133.

The next step is to cut opposing openings 106 and 108 in the mount 90 which are sized to admit the flapper 18 and nose seal 60, but leaving opposing support ribs 102 and 104 between the openings 106 and 108. While this can be done using conventional machining operations, it is preferred to perform this step by an electric discharge machine. Thus, holes 140 are drilled through the periphery of the mount 90 through opposite ends of a diameter and a EDM wire is inserted therethrough to simultaneously cut along the line 150 (FIG. 3) through opposite sides of the mount 90. This cuts the windows 106 and 108, but leaves the ribs 102 and 104. In addition, the hinge supports 114 are also cut for receiving the hinge of the flapper 18. In performing this operation by EDM, hinge supports 114 are provided at diametrically opposite sides, but the undesired set of hinges is suitably removed. After this, other minor machining operations may be performed, such as drilling the holes for the hinge pin 20 and retainer screws for the flapper spring 24.

Therefore, the unitary flapper mounting 90 is oriented relative to the remainder of the housing 12 and provides orientation between the various coacting parts. That is, the lower end 23 of the flow tube 22 with its contour similar to the sealing surface 19 of the curved flapper 18 is oriented and provides an evenly distributed load across the flapper 18 when the flow tube 22 is moved to the open position. And the mating downstop including nose seal 60, which is contoured to coact with the lower end 23 of the flow tube 22 is also oriented to insure that the flow tube 22, when opened, seals properly in the open position.

After manufacture of the mount 90, the flapper 18 and the seals 17 and 60 along with their retainers may be positioned in their proper recesses 136 and 138, respectively, through the windows 106 and 108.

The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts, and steps of the process, will readily suggest themselves to those skilled in the art, and which are encompassed within the spirit of the invention and the scope of the appended claims.

What is claimed is:

1. A subsurface well safety valve for controlling the fluid flow through a well conduit comprising, a housing having an axial bore therethrough, said housing including a one-piece flapper mount, a flapper valve closure member movable between open and closed positions relative to the valve seat and supported from the mount, said valve closure member being a sector of a cylinder having a concave surface which forms a sealing surface, said valve seat having a seating surface contoured to coact with the sealing surface, a flow tube telescopically movable in the housing for controlling the movement of the flapper valve closure member, a mating downstop carried by the mount below and positioned for engagement by the flow tube, and said flapper mount having opposing openings between the valve seat and the mating downstop, said openings sized for insertion of said flapper valve member.

2. The apparatus of claim 1 including first and second opposing ribs between the openings.

3. The apparatus of claim 1 wherein the flapper valve member is supported from the flapper mount by hinge means and said openings are rotationally positioned relative to the hinge means at 0° and 180°.

4. The apparatus of claim 3 including first and second opposing ribs, said ribs rotationally positioned relative to the hinge means at 90° and 270°.

5. The apparatus of claim 1 including, a nose seal carried by the mount below and positioned for engagement by the flow tube, and said nose seal adapted to be mounted in the flapper mount through said openings.

* * * * *